United States Patent [19]

Coulin

[11] 4,022,294

[45] May 10, 1977

[54] DEVICE FOR LUBRICATING THE GUIDING SYSTEM OF AN INTERNAL COMBUSTION ENGINE VALVE

[75] Inventor: Jean-Paul René Coulin, Enghien-les-Bains, France

[73] Assignee: Societe d'Etudes de Machines Thermiques, Saint Denis, France

[22] Filed: Nov. 21, 1975

[21] Appl. No.: 634,158

[30] Foreign Application Priority Data

Feb. 27, 1975 France ..... 75.06162

[52] U.S. Cl. ..... 184/6.9; 308/5 V; 123/188 GC

[51] Int. Cl.[2] ..... F01M 9/10

[58] Field of Search ..... 184/6.5, 6.9; 308/5 V; 123/188 GC, 90.33

[56] References Cited

UNITED STATES PATENTS

| | | | |
|---|---|---|---|
| 1,569,455 | 1/1926 | Burwell | 308/5 V |
| 1,751,716 | 3/1930 | Porth | 123/90.33 |
| 2,069,745 | 2/1937 | Allen | 184/6.9 |
| 2,153,284 | 4/1939 | Steiner | 308/5 V |
| 2,354,926 | 8/1944 | Patterson | 123/188 GC |
| 3,265,052 | 8/1966 | Goloff | 184/6.9 |
| 3,345,976 | 10/1967 | Pope | 123/188 GC |

FOREIGN PATENTS OR APPLICATIONS

| | | | |
|---|---|---|---|
| 759,487 | 7/1949 | Germany | 308/5 V |

*Primary Examiner*—Samuel Feinberg
*Attorney, Agent, or Firm*—Jay L. Chaskin

[57] ABSTRACT

The invention relates to a device for lubricating the guiding system of an internal combustion engine valve having at least one valve stem mounted in a guide. A first upper cavity communicates permanently with a second lower annular cavity through a conduit. The first cavity is selectively interconnected to a lubricant intake duct through a sliding valve comprising an annular groove on the valve stem. A third cavity between the intake duct and the slide valve provides lubrication of the upper portion of the valve guide.

3 Claims, 2 Drawing Figures

DEVICE FOR LUBRICATING THE GUIDING SYSTEM OF AN INTERNAL COMBUSTION ENGINE VALVE

The present invention relates to a device for lubricating the guiding system of an internal combustion engine valve in particular to the invention is a device for allowing oil under pressure to be supplied to the guiding system intermittently during a short instant, for example at the moment when the pressure of the gas is significant around the valve. The invention is directed to lubricating the valve guides, without excess by using the movement of the valve which thus itself regulates the frequency of oil emissions depending upon the rate of its displacement.

Such devices are already known in the prior art and are composed of two cavities, viz. an upper cavity and a lower cavity provided in the valve guide. The upper cavity receives the oil from a supply conduit through the medium of a slide-valve connected to the valve stem. The upper cavity is connected with the lower cavity permanently through the medium of a second conduit. The slide-valve connected to the valve stem is used as a commutating means for selectively interconnecting the supply conduit and the upper cavity and therefore intermittently supplying the lower cavity through the medium of the second conduit.

With such a device the upper portion of the guide is not lubricated permanently and there is no return circuit allowing part of the lubricating oil to be recovered.

In order to remedy these drawbacks, the invention provides a device for lubricating a guiding system of an internal combustion engine valve in which at least one valve stem is mounted in a guide, the device comprising a first upper cavity, a second lower annular cavity communicating permanently with the first cavity, a lubricant intake duct and commutating means forming a slide-valve connected to the valve stem in order to selectively interconnect the duct and the second cavity, and a third cavity arranged between the duct and the commutating means.

One of the advantages of the device according to the invention lies in the fact that the upper portion of the valve guide is lubricated permanently.

Another object of the invention is to provide a lubricant return conduit which is connected with a discharge cavity mounted between the upper portion and the lower portion of the valve guide, which is preferably composed of two distinct portions.

Figure 1:
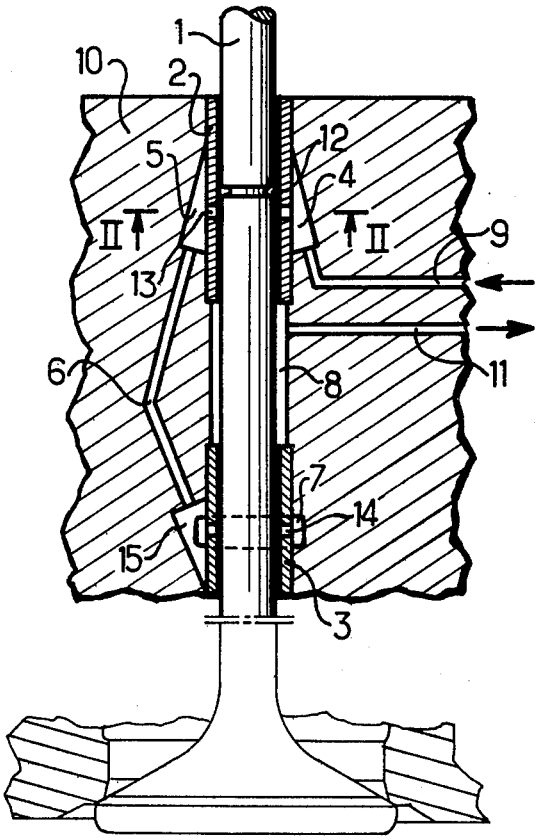
Figure 2:
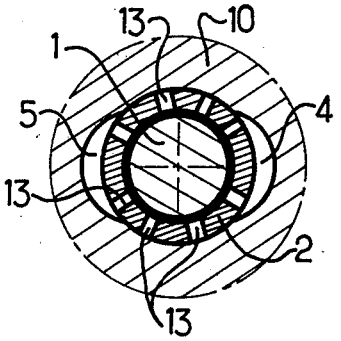

The present invention will be better understood and other purposes, features, details and advantages of the latter will appear more clearly from the following explanatory description made with reference to the appended diagrammatic drawings given solely by way of non limitative example, illustrating a presently preferred specific form of embodiment and wherein:

FIG. 1 is a longitudinal sectional view of the lubricating device according to the invention; and FIG. 2 is a sectional view upon the line II—II of FIG. 1, with the valve guide slightly shifted in order to better illustrate its features.

In FIG. 1, a valve stem 1 is mounted in a valve guiding system, which comprises an upper guide 2 and a lower guide 3 tightly fitted in the cylinder head 10.

In the upper guide 2 are provided two independent cavities 4 and 5 arranged at substantially one and the same level.

The upper cavity 5 permanently communicates with the lower annular cavity 7 through the medium of a lateral duct 6 and a cavity 15.

A discharge cavity 8 is provided between the upper cavities 4, 5 and the lower cavity 7 and communicates for example with the engine case through the medium of a return conduit 11. An intake conduit 9 conveys the oil into the upper cavity 4.

The valve stem 1 is provided with an annular groove 12 and the upper valve guide 2 is provided with a plurality of radial openings 13 to allow the said cavities 4, 5 to communicate with one another only when the groove passes in front of the radial openings 13. The lower valve guide is provided with a certain number of openings 14 allowing the oil to be distributed.

The lubricating oil conveying circuit is determined by the supply conduit 9, the upper cavity 4, the annular groove 12 of the valve stem, the upper cavity 5, the lateral conduit 6, the lower annular cavity 7, the discharge cavity 8, and the return conduit 11.

Thus, oil under pressure proceeding from a lubricating circuit (not shown) is permanently conveyed into the lateral upper cavity 4 through the medium of the supply conduit 9 connected to the lubricating circuit, thus allowing the upper guide 2 to be lubricated permanently, i.e. whatever the position of the valve stem.

In the position shown in FIG. 1, which corresponds to the closed position of the valve, the upper cavity 4 and the upper cavity 5 do not communicate with one another, since the annular groove 12 of the valve stem is not opposite the radial openings 13 located at one and the same level of the upper guide 2. Thus, in this position, only the upper guide 2 is lubricated.

When the valve opens, the valve stem 1 is displaced so that the annular groove 12 passes in front of the radial openings 13. In this manner, the lubricant can pass from the upper cavity 4 into the upper cavity 5, which are preferably diametrally opposed. The lubricant contained in cavity 5 then passes directly into the lower cavity 7 through the lateral conduit 6, thus allowing the lower valve guide 3 to be lubricated.

Thus, the device allows the oil under pressure to be conveyed intermittently at the desired moment during a short instant into the lower valve guide 3, using the movement of the valve which thus itself regulates the frequency of oil emissions depending upon the rate of its displacement.

Simultaneously with the lubricating action in the upper and lower portions of the valve stem, the oil under pressure opposes the rise of the gases, if any. During its displacement, the oil carries along the gums or other products which may be forming along the valve stem and may hinder its closing.

The discharge cavity 8 which communicates with the engine case ensures the return of a portion of the lubricating oil into the case, thus preventing an overpressure which may lead to permanent lubrication resulting in excessive oil consumption.

The lubricating device according to the invention is therefore composed of two portions which are combined with one another through the medium of the lateral duct 6.

The first portion or upper portion ensures, on the one hand, a permanent lubrication of the upper valve guide and, on the other hand, an intermittent supply of oil into the lower annular cavity 7.

The second portion of the device allows the proper lubrication of the lower guide as well as the return of a portion of the lubricating oil towards the engine case.

It is obvious that the device may be used in both intake valves and exhaust valves.

If a non-coupled oil pump, i.e. an oil pump provided with individual actuating means which is mechanically independent of the engine, is used case, in order that the oil be supplied only after the engine has accomplished a few turns. This in order to prevent the oil from passing into the engine cylinder.

Of course, the invention is by no means limited to the form of embodiment which has been described and which has been given by way of example only. It comprises all the technical equivalents of the means described and the combinations thereof if same are used within the gist of the invention and the scope of the appended claims.

What is claimed is:

1. A device for lubricating the guiding system of an internal combustion engine valve, in which at least one valve stem is mounted in a guide means; an upper cavity in selective interconnection with the valve stem; a lower annular cavity communicating permanently with the upper cavity through a duct; a lubricant intake duct; and means forming a slide-valve on the valve stem for selectively interconnecting the lubricant intake duct and the lower cavity; a third cavity located at one and the same level around the valve stem and substantially diametrically opposite to said upper cavity and arranged between the slide-valve means and the lubricant intake duct, said lubricant duct being in permanent communication with the third cavity, said slide-valve means being formed by a portion of the valve stem having an annular groove forming a passageway for the lubricant between the upper cavity and the third cavity.

2. A device according to claim 1, wherein said annular groove communicates with the upper cavity and the third cavity respectively through at least one radial opening passing through the guide means.

3. A device according to claim 1, wherein an annular discharge cavity is connected to a lubricant return conduit, and the guide means comprises an upper portion and a lower portion separated by the discharge cavity.

* * * * *